US008814605B2

(12) United States Patent
Yu et al.

(10) Patent No.: US 8,814,605 B2
(45) Date of Patent: Aug. 26, 2014

(54) POWER CONNECTOR

(75) Inventors: Wang-I Yu, Jhonghe (TW); Hung-Chi Tai, Jhonghe (TW); Zhi-Qiang Rong, Taicang (CN)

(73) Assignee: Alltop Electronics (Suzhou) Ltd., Taicang (CN)

( * ) Notice: Subject to any disclaimer, the term of this patent is extended or adjusted under 35 U.S.C. 154(b) by 207 days.

(21) Appl. No.: 13/351,715

(22) Filed: Jan. 17, 2012

(65) Prior Publication Data

US 2012/0142227 A1 Jun. 7, 2012

Related U.S. Application Data

(63) Continuation-in-part of application No. 13/179,888, filed on Jul. 11, 2011, now Pat. No. 8,328,583, which is a continuation of application No. 12/436,492, filed on May 6, 2009, now Pat. No. 7,997,936.

(30) Foreign Application Priority Data

Dec. 26, 2008 (CN) ..... 2008 1 0189939

(51) Int. Cl.

| | |
|---|---|
| ***H01R 13/502*** | (2006.01) |
| ***H01R 13/506*** | (2006.01) |
| ***H01R 12/71*** | (2011.01) |
| *H01R 103/00* | (2006.01) |

(52) U.S. Cl.

CPC ..... *H01R 13/506* (2013.01); *H01R 12/712* (2013.01); *H01R 2103/00* (2013.01); *Y10S 439/947* (2013.01)

USPC ..... 439/689; 439/947

(58) Field of Classification Search

USPC ..... 439/651, 131, 148, 190, 191, 194, 205, 439/206, 485, 689, 752, 857, 947

See application file for complete search history.

(56) References Cited

U.S. PATENT DOCUMENTS

| | | | | |
|---|---|---|---|---|
| 4,593,960 | A | 6/1986 | Millhimes et al. | |
| 5,362,261 | A * | 11/1994 | Puerner | 439/752 |
| 5,501,606 | A | 3/1996 | Oda et al. | |
| 5,618,187 | A * | 4/1997 | Goto | 439/79 |
| 5,993,255 | A | 11/1999 | Yurko | |
| 6,027,360 | A | 2/2000 | Jenkins | |
| 6,319,075 | B1 | 11/2001 | Clark et al. | |
| 6,394,844 | B1 * | 5/2002 | Frias Valero et al. | 439/607.07 |
| 6,805,591 | B2 | 10/2004 | Garland et al. | |
| 6,835,103 | B2 * | 12/2004 | Middlehurst et al. | 439/699.1 |
| 6,848,953 | B2 * | 2/2005 | Schell et al. | 439/825 |
| 7,011,548 | B2 * | 3/2006 | Bogiel et al. | 439/630 |
| 7,374,436 | B2 * | 5/2008 | Schell et al. | 439/79 |
| 8,419,477 | B1 * | 4/2013 | Yu et al. | 439/626 |
| 8,545,270 | B2 * | 10/2013 | Yu et al. | 439/626 |
| 8,662,923 | B2 * | 3/2014 | Wu | 439/595 |
| 2009/0157938 | A1 | 6/2009 | Hunkins et al. | |
| 2009/0197444 | A1 | 8/2009 | De Blieck | |

* cited by examiner

*Primary Examiner* — Neil Abrams
*Assistant Examiner* — Travis Chambers
(74) *Attorney, Agent, or Firm* — Sughrue Mion, PLLC

(57) ABSTRACT

A power connector includes an insulative housing, a number of contacts retained in the insulative housing and a spacer fixed to the insulative housing. The insulative housing includes a mating surface, an end surface opposite to the mating surface and a plurality of passageways extending through the mating and the end surfaces. A depression and a cavity are recessed into the insulative housing from the mating surface and the end surface, respectively. Each contact includes a main portion received in corresponding passageway and a tail portion located in the cavity in condition that at least one side wall of the tail portion is exposed to the air for excellent heat dissipation.

17 Claims, 8 Drawing Sheets

POWER CONNECTOR

CROSS-REFERENCE TO RELATED APPLICATIONS

This patent application is a continuation-in-part application of U.S. patent application Ser. No. 13/179,888, filed on Jul. 11, 2011, which issued as U.S. Pat. No. 8,328,583 on Dec. 11, 2012, which is a continuation of U.S. patent application Ser. No. 12/436,492, filed on May 6, 2009, which issued as U.S. Pat. No. 7,997,936, on Aug. 16, 2011. The above-referenced applications are incorporated herein by reference in their entireties.

BACKGROUND OF THE INVENTION

1. Field of the Invention

The present invention relates to a power connector, more particularly to a power connector for being mounted on a circuit board and with improved heat dissipation structure.

2. Description of Related Art

Designers of electronic circuits generally are concerned with two basic circuit portions, the logic or signal portion and the power portion. In designing logic circuits, the designer usually does not have to take into account any changes in electrical properties, such as resistance of circuit components, that are brought about by changes in conditions, such as temperature, because current flows in logic circuits are usually relatively low. However, power circuits can undergo changes in electrical properties because of the relatively high current flows, for example, on the order of 30 amps or more in certain electronic equipment. Consequently, connectors designed for use in power circuits must be capable of dissipating heat (generated primarily as a result of the Joule effect) so that changes in circuit characteristics as a result of changing current flow are minimized.

U.S. Pat. No. 7,374,436 discloses a power connector assembly which includes a power receptacle mounted on a printed circuit board (PCB) and a power plug for mating with the power receptacle. As shown in FIG. 1, the power receptacle includes an insulative housing and a plurality of contacts 414 retained in the insulative housing. Each contact 414 includes opposite flat portions 418, 420, a pair of extensions 430, 432 extending backwardly from the corresponding flat portions 418, 420, and a pair of U-shaped connecting portions 422, 424 connecting the flat portions 418, 420. When the power plug is inserted into the power receptacle, contacts of the power plug are received in the space between the opposite flat portions 418, 420. During insertion, the opposite flat portions 418, 420 are outwardly deformable engaged by the contacts of the power plug. The U-shaped connecting portions 422, 424 suffer from such engaging force and provide counter force for prohibiting over-deformation of the flat portions 418, 420. However, the configuration of such contacts 414 are complex and difficult for manufacture. Besides, the connecting portions 422, 424 might be chapped under out force result from the frequently insertion of the power plug into the power receptacle.

Besides, in assembly, the contacts 414 are inserted into the corresponding passageways from a lower-to-upper direction. The power receptacle further includes a side spacer 438 sidewardly fixed to the insulative housing and covering the contacts 414. A fixing block 468 is also provided for pressing the contacts 414 in order to prevent moveable of the contacts 414 along a vertical direction. However, with the side spacer 438 sidewardly fixed to the insulative housing, the contacts 414 might be shielded by such side spacer 438. Parts of the contacts 414 exposed to the outside must be decreased, which results in poor heat dissipation of the power receptacle.

Hence, a power connector with improved heat dissipation structure is needed to solve the problem above.

BRIEF SUMMARY OF THE INVENTION

A power connector in accordance with the present invention includes an insulative housing having a mating surface, a plurality of first passageways extending through the mating surface, and a plurality of second passageways extending through the mating surface and located at a lateral side of the first passageways. A plurality of separated first contacts are arranged in pairs, each of which has a first main portion received in corresponding first passageway, a first mating portion extending forwards from the first main portion, and a first tail portion extending oppositely from the first main portion. The first main portion and the first mating portion are extending along a first plane. A plurality of separated second contacts are received in the second passageways, each of which has a second main portion, a second mating portion and a second tail portion extending from opposite ends of the second main portion. The second tail portion of the second contact is extending along a second plane perpendicular to the first plane.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 2:
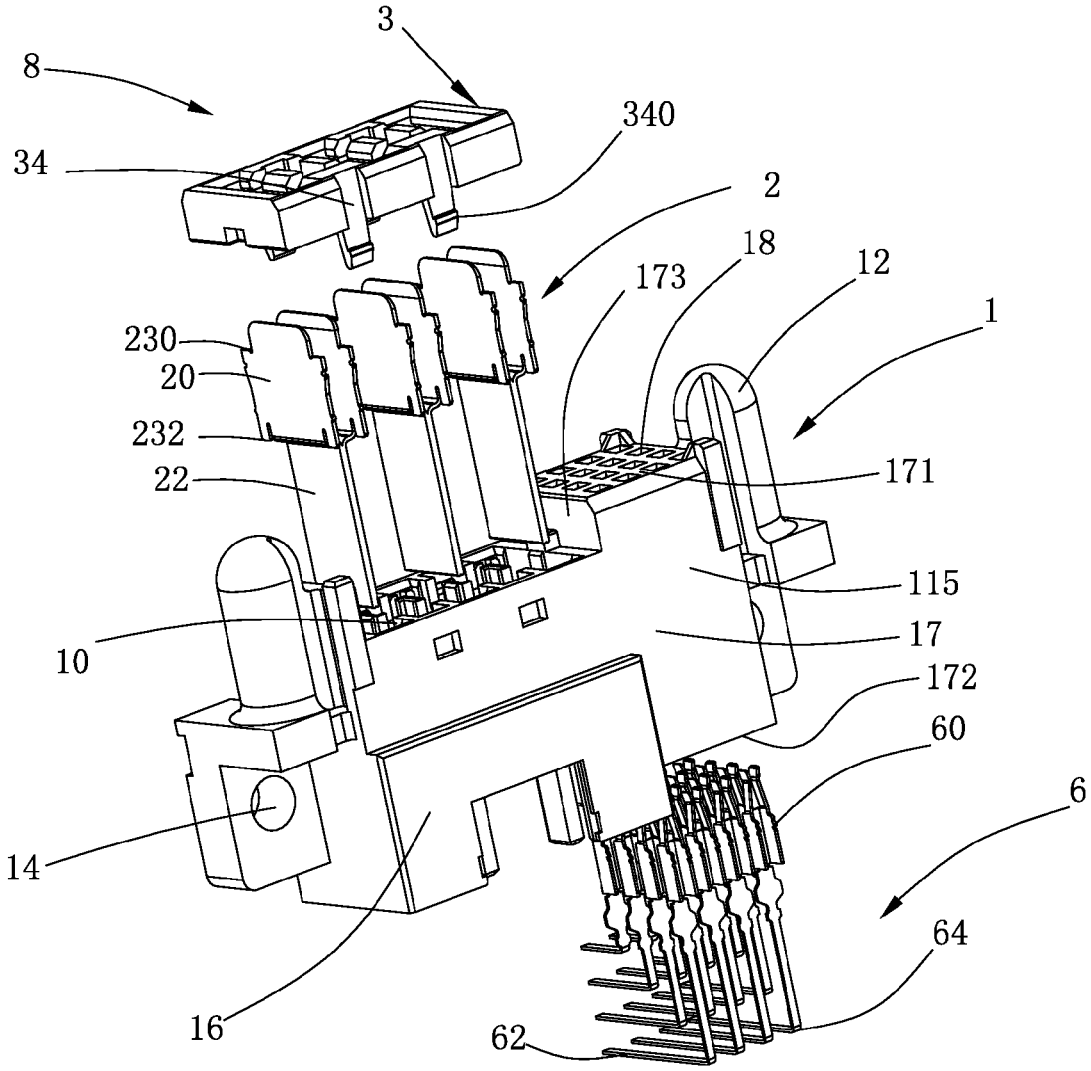
FIG. 2 is an exploded view of a power connector according to the preferred embodiment of the present invention.
Figure 3:
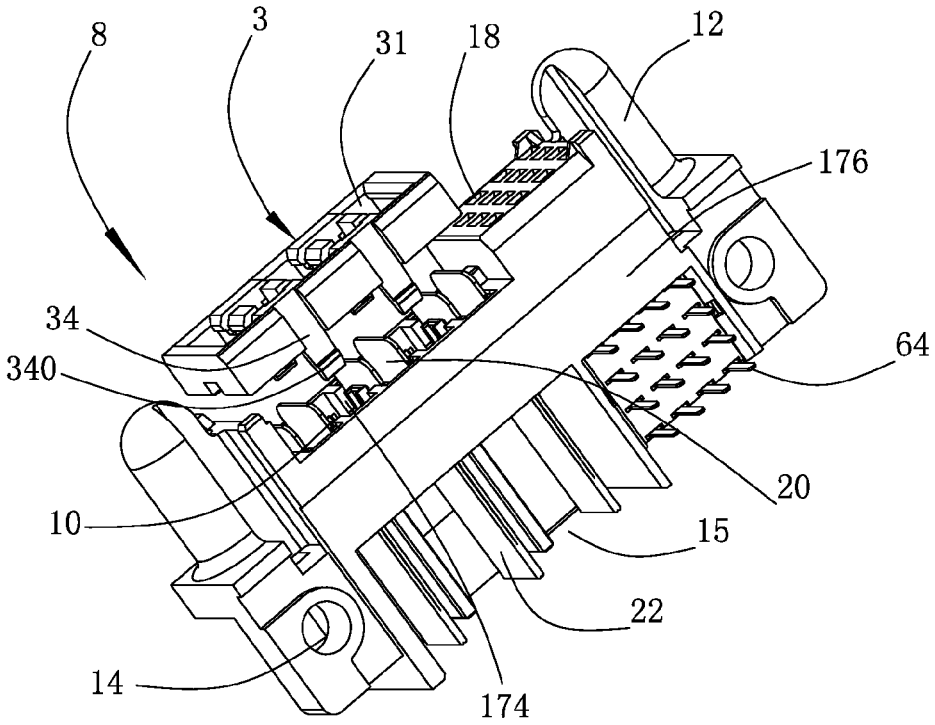
FIG. 3 is a part exploded view of the power connector shown in FIG. 2 while with a spacer spaced apart therefrom.
Figure 4:
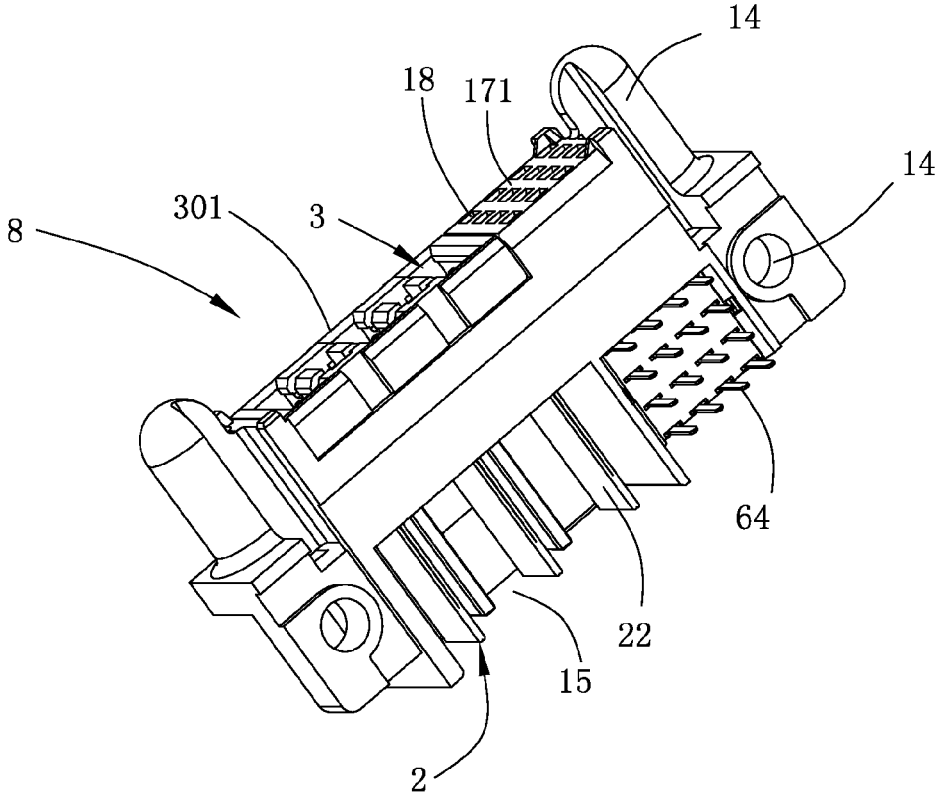
FIG. 4 is a perspective view of the power connector shown in FIG. 2 with the spacer mounted to an insulative housing.

Referring to FIGS. 2-4, the present invention relates to a power connector 8 mounted on a printed circuit board (not shown) for mating with a corresponding connector (not shown) for power transmission. The power connector 8 includes an insulative housing 1, a plurality of first and second contacts 2, 6 received in the insulative housing 1 and a spacer 3 fixed to the insulative housing 1.

Figure 8:
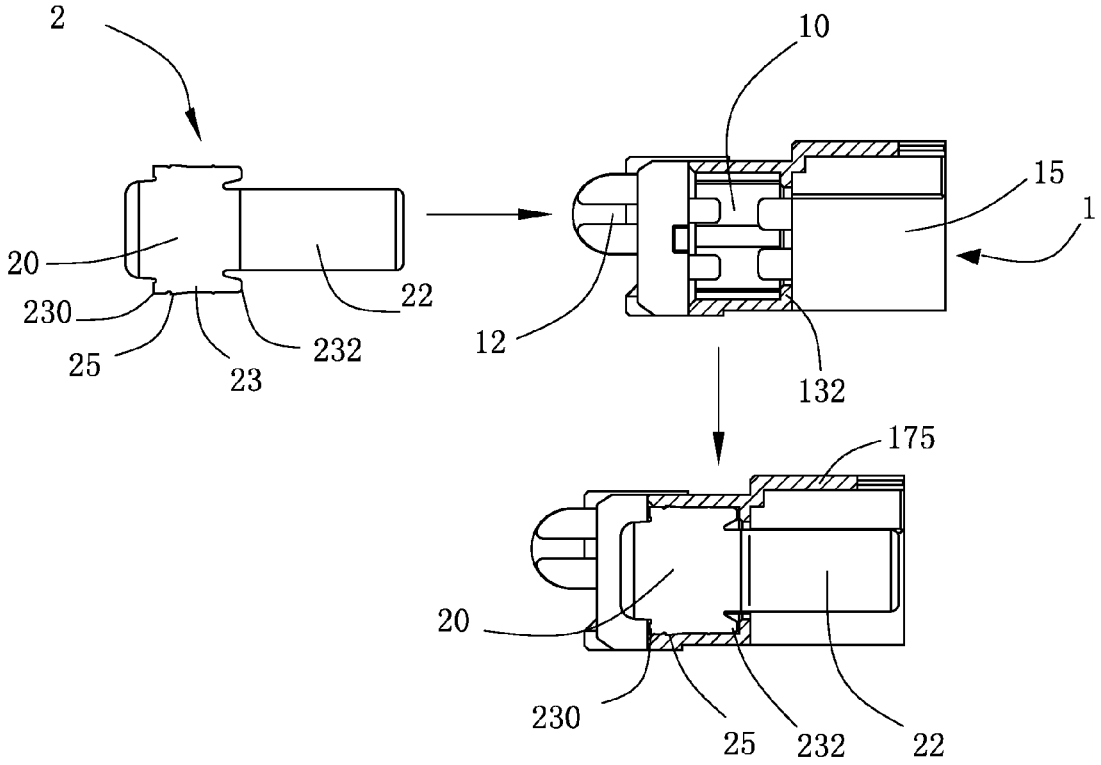
FIG. 8 is a cross-sectional view of the power connector according to the preferred embodiment of the present invention showing steps of the first contacts assembled to the insulative housing.

The insulative housing 1 defines a body portion 17, a pair of guiding posts 12 sidewardly and forwardly extending from lateral sides of the body portion 17, and a pair of mounting holes 14 adjacent to the guiding posts 12 for mounting the power connector 8 to the PCB. The body portion 17 includes a front mating surface 171, a rear stepped end surface 172 and a pair of first and second passageways 10, 18 extending through the mating and the end surfaces 171, 172. The first passageways 10 are provided for receiving the first contacts 2. The second passageways 18 are located on a lateral side of the first passageways 10 and are provided for receiving the second contacts 6. The insulative housing 1 includes a depression 173 recessed from the mating surface 171 and a cavity 15 recessed from the end surface 172. Both of the depression 173 and the cavity 15 extend into the body portion 17 and in communication with the first passageways 10 as best shown in FIG. 8. The first passageways 10 are terminated in the depression 173. A plurality of fixing holes 174 are recessed from the depression 173 and further extend backwardly into the body portion 17. The body portion 17 includes a top wall 175 and a bottom wall 176 opposite to the top wall 175. The depression 173 extends through the top and the bottom walls 175, 176 for receiving the spacer 3. The top wall 175 backwardly extends to cover the cavity 15 in order to protect the first contacts 2. The cavity 15 extends through the bottom wall 176 and is exposed to the outside.

Figure 5:
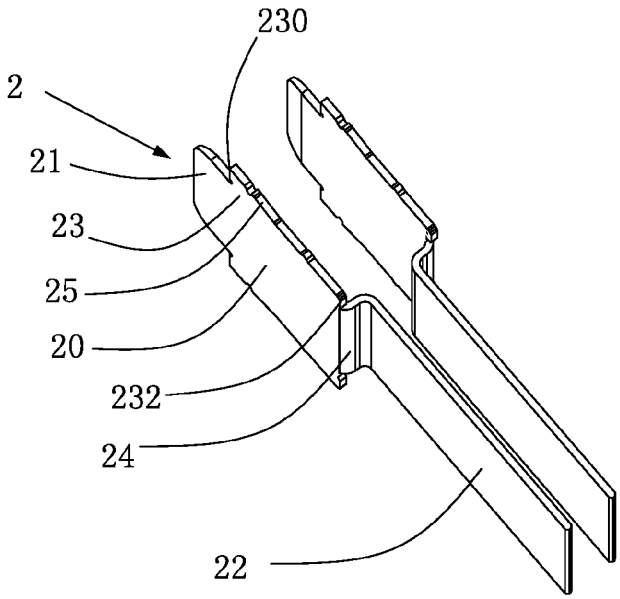
FIG. 5 is a perspective view of a pair of first contacts of the power connector shown in FIG. 2.
Figure 6:
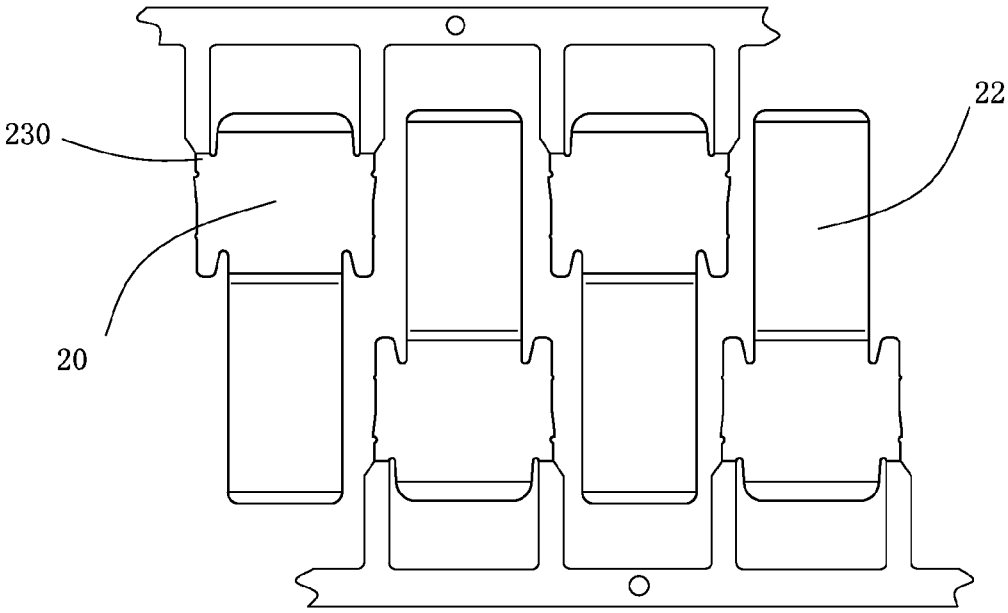
FIG. 6 is a top view of the first contacts shown in FIG. 5 while connecting with material belts.

Referring to FIGS. 5, 6 and 8, the first contacts 2 are arranged in pairs and each first contact 2 includes a main portion 20, a mating portion 21 extending forwardly from the main portion 20, a bending portion 24 sidewardly extending from the main portion 20, and a tail portion 22 extending backwardly from the bending portion 24. The mating portion 21 and the tail portion 22 are both contracted with respect to the main portion 20. Each first contact 2 is substantially plate-shaped with the mating portion 21 coplanar with the main portion 20 and the tail portion 22 parallel to the main portion 20. The main portion 20 further includes a pair of wing portions 23 located at upper and lower sides thereof. Each wing portion 23 includes a front end 230 and a rear end 232 for fixation and position.

Figure 1:
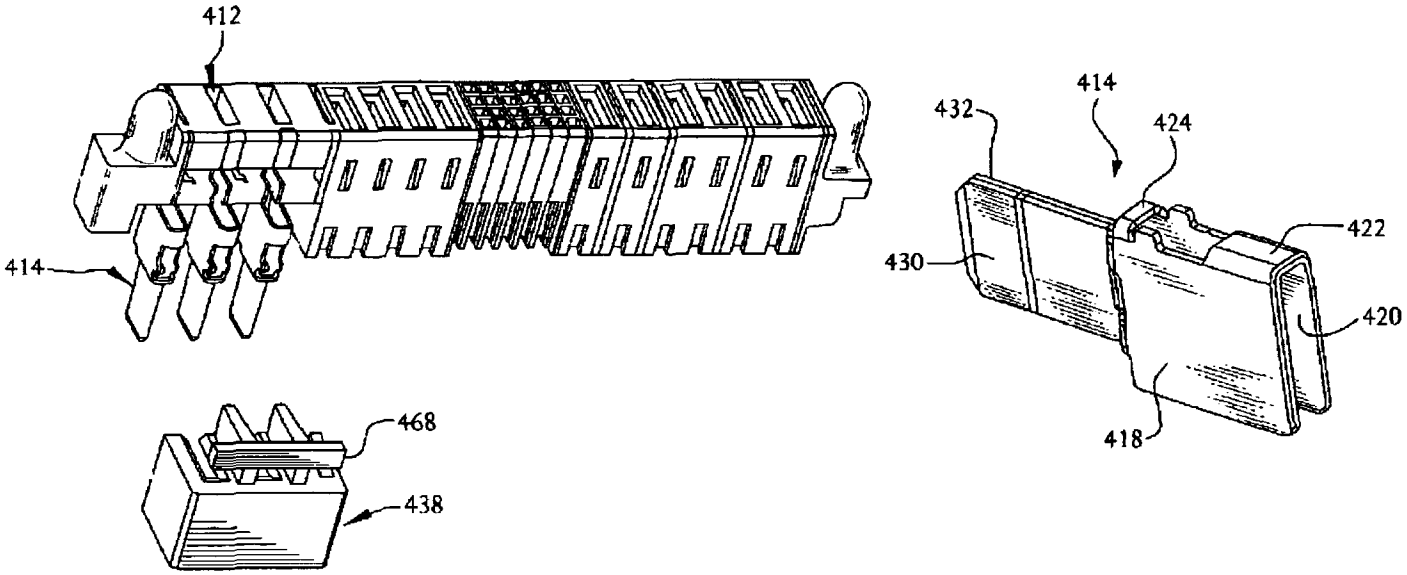
FIG. 1 RELATED ART
FIG. 1 is a part exploded view of an existing power connector.

As shown in FIG. 6, the first contacts 2 can be alternately arranged in a metal material sheet and can be stamped from the metal material sheet in order to save metal material. Since the first contacts 2 are of simple structures, manufacture cost of the first contacts 2 can be reduced as well. Besides, the first contacts 2 are of the same configuration after manufacture so that any two first contacts 2 can be combined to a pair in assembly. Each pair of the first contacts 2, as shown in FIG. 2, are symmetrical along a front-to-rear direction. Take any one pair of the first contacts 2 for example, a space between the tail portions 22 of such pair of the first contacts 2 is much smaller than that between the main portions 20 of such pair of the first contacts 2. Such pair of the first contacts 2 jointly function as one contact 414 shown in FIG. 1. As shown in FIG. 6, before assembly, the first contacts 2 of such pair are separate from each other and no connecting portion is needed for connecting the pair of the first contacts 2, as a result that chapped risk of the connecting portion is entirely avoided. The tail portions 22 of such pair of the first contacts 2 are attached to and overlap with each other so that the main portions 20 of such pair of the first contacts 2 function as opposite contact portions 418, 420 of the contact 414 shown in FIG. 1. In assembly, a cable is mechanically connected to the tail portions 22 of such pair of the first contacts 2 via soldering or clipping method.

Each second contact 6 includes a second contact portion 60 received in the corresponding second passageways 18, a second tail portion 62 perpendicular to the second contact portion 60, and a bending portion 64 between the second contact portion 60 and the second tail portion 62. The second contacts 6 are arranged in multiple layers and step configurations so that the second contacts 6 of each row can be inserted through the PCB simultaneously. The second contacts 6 are assembled to the insulative housing 1 along a rear-to-front direction.

Figure 7:
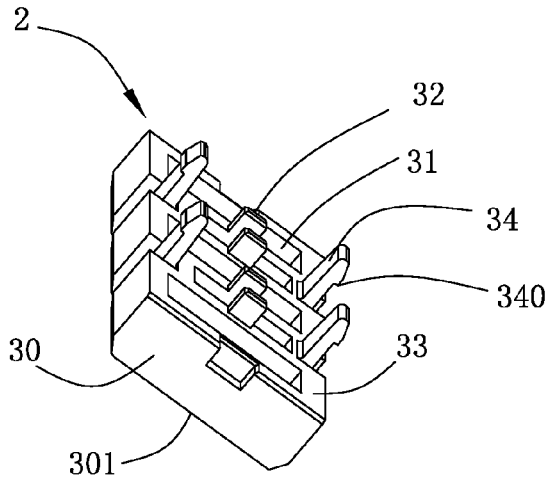
FIG. 7 is a perspective view of the spacer shown in FIG. 3.

Referring to FIG. 7, the spacer 3 includes a main body 30, two pairs of locking arms 34 cantileveredly protruding from the main body 30, and a plurality of extensions 32 extending from an inner side 33 of the main body 30. The main body 30 includes a front insertion surface 301 and a plurality of through holes 31 extending through the insertion surface 301 and main body 30. Each locking arm 34 includes a hook 340 at a distal end thereof for abutting against the corresponding fixing hole 174 so that the spacer 3 can be stably retained in the depression 173. When the spacer 3 is received in the depression 173, the insertion surface 301 and the mating surface 171 are coplanar with each other.

Figure 9:
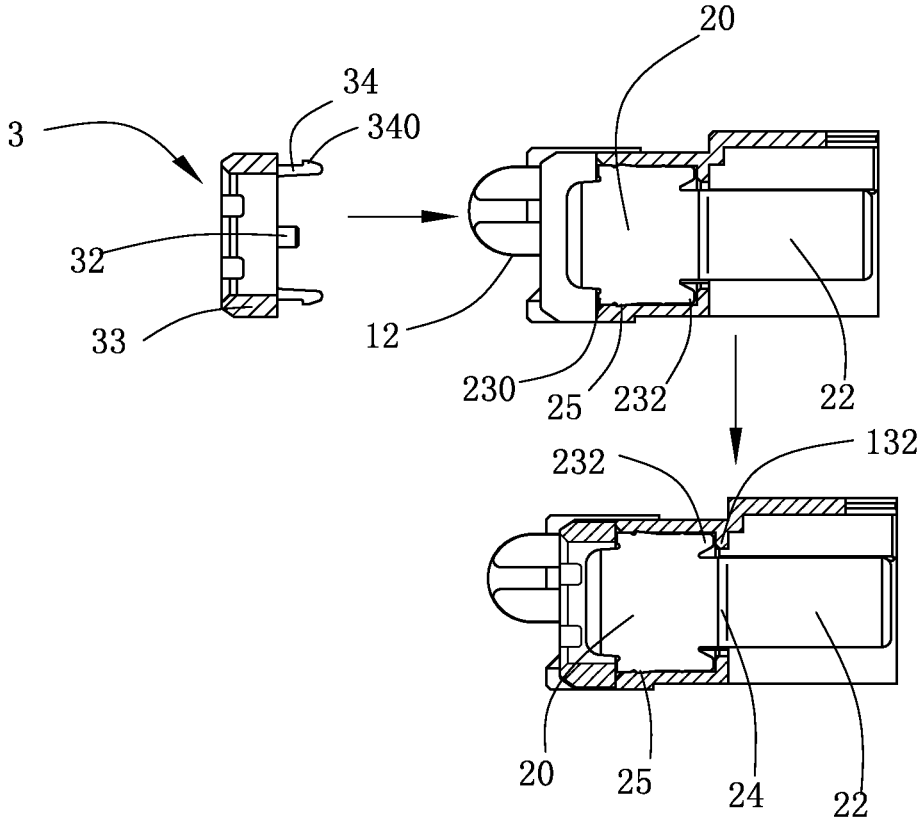
FIG. 9 is a cross-sectional view of the power connector according to the preferred embodiment of the present invention showing steps of the spacer assembled to the insulative housing.

Referring to FIGS. 8&9, in assembly, the first contacts 2 are assembled to the insulative housing 1 along the front-to-rear direction via the tail portions 22 being firstly inserted into the first passageways 10. The second contacts 6 are assembled to the insulative housing 1 along the rear-to-front direction opposite to the front-to-rear direction. The insulative housing 1 includes a plurality of protrusions 132 protruding into the first passageways 10 to abut against the rear ends 232 of the main portions 20 in order to stop further insertion of the first contacts 2 into the first passageways 10. The mating portions 21 and the tail portions 22 protrude into the depression 173 and the cavity 15, respectively. The tail portions 22 are shielded by the top wall 175 for protection. Since the cavity 15 is exposed to the outside, at least one side wall of the tail portions 22 of each pair is exposed to the outside through the bottom wall 176 and the end surface 172. As a result, heat dissipation of the power connector 8 can be improved because most part of tail portions 22 are exposed to the air, which can result in excellent convection flow.

The spacer 3 is assembled to the insulative housing 1 along the front-to-rear direction as well. The main body 30 is received in the depression 173. The locking arm 34 is received into the fixing holes 174 with the hook 340 abuts against the fixing hole 174. The inner side 33 of the main body 30 presses against the front ends 230 of the wing portions 23 in order to prevent forwardly moveable of the first contacts 2. The extensions 32 are received in the corresponding holes (not labelled) defined in the insulative housing 1 for guiding insertion of the spacer 3.

Figure 10:
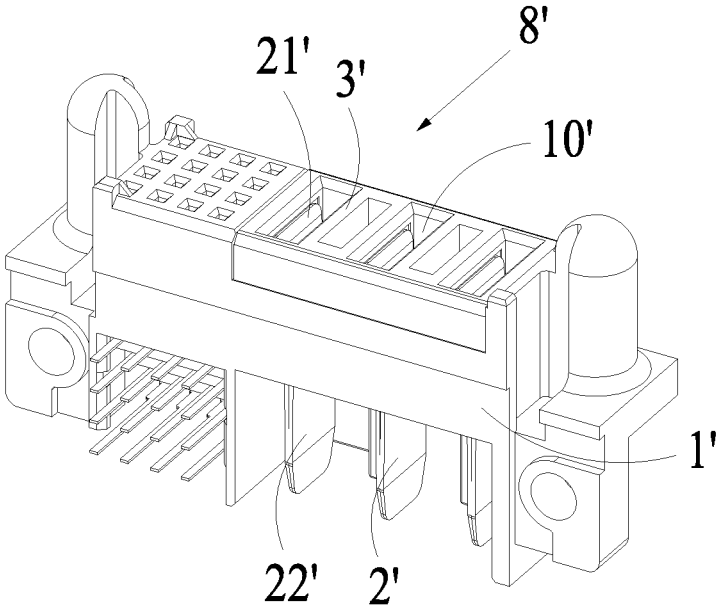
FIG. 10 is a perspective view of the power connector in accordance with a second embodiment.
Figure 11:
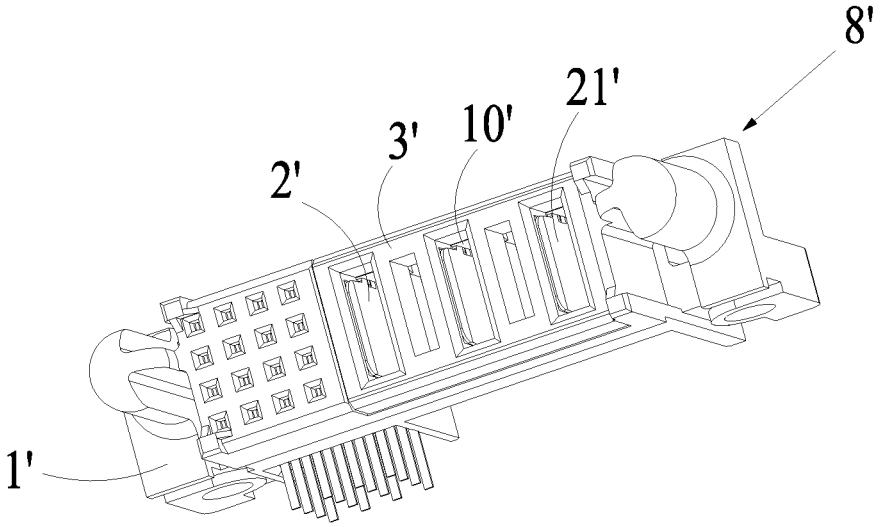
FIG. 11 is another perspective view of the power connector.

FIGS. 10-11 illustrates a second embodiment of the present invention. In this embodiment, the basic structure is similar to that of the power connector shown in FIGS. 1-9. Similar structural details will not be introduced hereinafter.

Figure 12:
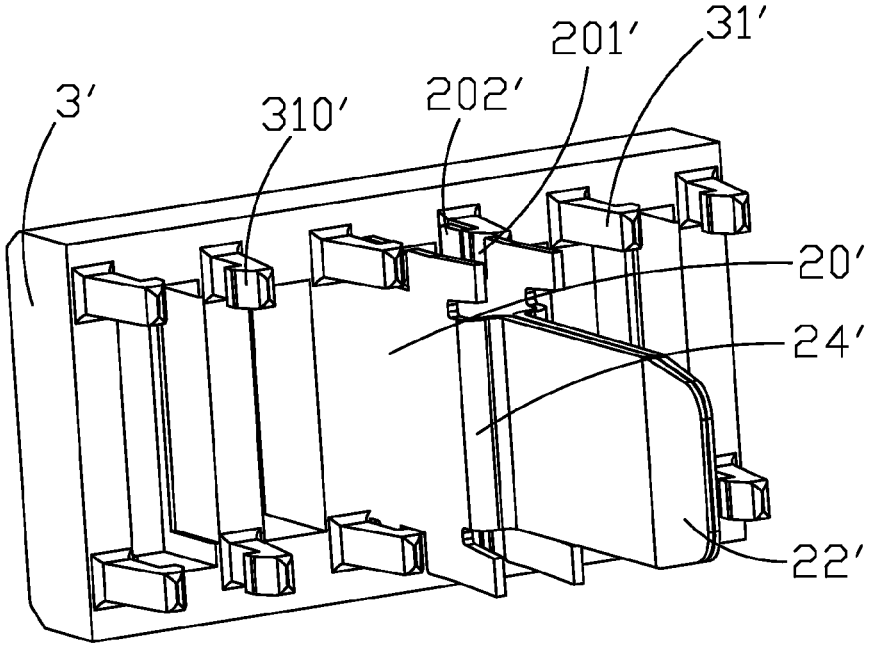
FIG. 12 is a perspective view of the spacer and a pair of contacts shown in FIG. 10.

The power connector 8' shown in FIGS. 10-11 includes a spacer 3' and a plurality of power contacts 2' in accordance with the second embodiment. The plurality of power contacts 2' are arranged in pairs as disclosed above. Referring to FIG. 12, Each power contact 2' has a main portion 20', a mating portion 21' extending forwardly from the main portion 20', a bending portion 24' sidewardly extending from the main portion 20', and a tail portion 22' extending rearwards from the bending portion 24'. The mating portion 21' and the tail portion 22' are both contracted with respect to the main portion 20'. Each power contact 2' is substantially plate-shaped with the mating portion 21' coplanar with the main portion 20' and the tail portion 22' parallel to the main portion 20'. The main portion 20' defines a pair of opposite cutouts 201' along a top edge and a bottom edge thereof. A pair of protrusions 202' are arranged on the top and the bottom edges adjacent to corresponding cutouts 201'. The protrusions 202' abut against an inner face of corresponding passageway 10' of the insulative housing 1'. The insulative housing 1' provides a stopper (not shown) in front of the passageway 10' and the protrusion 202' is stopped by the stopper when the contact 2' is moving along a front-to-back direction.

Figure 13:
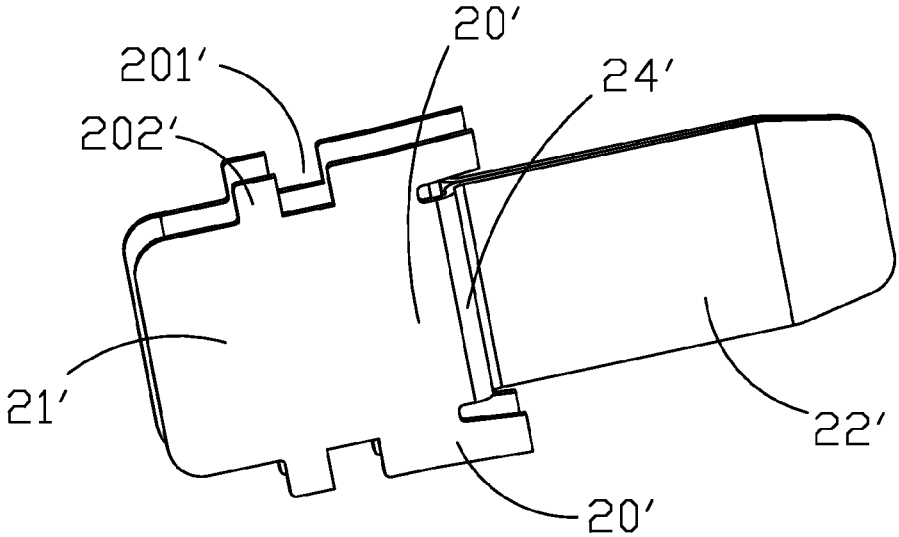
FIG. 13 is a perspective view of the pair of contacts shown in FIG. 10.

Turning to FIG. 13, the spacer 3' with a pair of power contacts 2' assembled therewith is illustrated. The spacer 3' comprises a main body 30', a plurality of locking arms 31' extending rearwards from a rear face of the main body 30'. The plurality of locking arms 31' are arranged in pairs. Each locking arm 31' forms a locking end 310'. The locking end 310' is locked into the cutout 201' of corresponding contact 2'. When the power contacts 2' are inserted into the power connector 8' from a rear of the connector 8', the pair of locking arms 31' holds the pair of power contacts 2' in position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. A power connector mountable on a circuit board for mating with a complementary connector, comprising:

an insulative housing having a front surface, an end surface opposite to the front surface and a plurality of passageways extending through the front surface and the end surface, a depression being recessed into the insulative housing from the front surface;

pairs of contacts received in the insulative housing along an insertion direction of the complementary connector, each contact having a main portion received in the corresponding passageway, a mating portion and a tail portion extending from opposite sides of the main portion and exposed to the air, each contact defining a cutout along a top edge and a bottom edge of the main portion; and a spacer received in the depression and defining a plurality of through holes communicating with the passageways for receiving the mating portions of the contacts, respectively, the spacer providing pairs of locking arms extending rearwards, each locking arm having a locking end retained in the cutout of corresponding contact to thereby limit a front-to-back displacement of the contacts.

2. The power connector as claimed in claim 1, wherein the spacer has a top surface and wherein the insulative housing has a top face, the top surface of the spacer being coplanar with the top face of the insulative housing.

3. The power connector as claimed in claim 1, further comprising a plurality of signal contacts arranged adjacent to the pairs of contacts.

4. The power connector as claimed in claim 1, wherein each contact forms a pair of protrusions on opposite top and bottom edges of the main portion, said pair of protrusions arranged besides the cutouts and abutting against inner faces of corresponding passageway.

5. The power connector as claimed in claim 4, wherein both the mating portion and tail portion of the contact are contracted with respect to the main portion.

6. The power connector as claimed in claim 5, wherein each contact is plate-shaped with the mating portion and the main portion coplanar with each other, and wherein the tail portion extends sidewards from the main portion and is parallel to the main portion.

7. The power connector as claimed in claim 6, wherein the tail portions of each pair of contacts are abutting against each other and extend out from the end surface.

8. The power connector as claimed in claim 7, wherein a space between the tail portions of the contacts of each pair is smaller than that between the main portions of the contacts of such pair.

9. The power connector as claimed in claim 1, wherein a pair of guiding posts are integrally formed with the insulative housing and projecting along the insertion direction of the complementary connector.

10. The power connector as claimed in claim 9, wherein the insulative housing defines a pair of mounting holes adjacent to corresponding guiding posts for facilitating mounting the power connector on the circuit board.

11. A power connector for engaging with a complementary connector, comprising:

an insulative housing defining a plurality of first passageways and a plurality of second passageway communicating with corresponding first passageways; and pairs of contacts received in the insulative housing, each pair of contacts composed by two separated contacts, each separated contact having a main portion assembled in the first passageway, a mating portion extending forwards within the second passageway, and a tail portion extending rearwards out of the insulative housing, each separated contact defining a pair of cutouts along a top and a bottom edges of the main portion;

wherein a height of the first passageway in a cross-section view is larger than a height of the second passageway in a cross-section view;

wherein the insulative housing comprises a first body portion and a second body portion assembled with the first body portion, and wherein the first passageways are defined through the first body portion and the second passageways are defined through the second body portion;

wherein each separated contact has a pair of protrusion oppositely formed on the top and the bottom edges of the main portion and received substantially in the first passageway, and wherein each protrusion abuts against an inner faces of the first passageway; and wherein the first body portion of the insulative housing forms a pair of stoppers in the front of the first passageway, and wherein the protrusion of the contact is limited by the stopper along a front-to-back direction.

12. The power connector as claimed in claim 11, wherein the second body portion of the insulative housing provides a plurality of pairs of locking arms extending rearwards, and wherein each locking arm has a locking end received in the cutout of corresponding contact to thereby limit the contact along the front-to-back direction.

13. The power connector as claimed in claim 11, further comprising a plurality of signal contacts received in the insulative housing.

14. A power connector mountable on a circuit board for mating with a complementary connector, comprising:

an insulative housing having a front surface, an end surface opposite to the front surface and a plurality of passageways extending through the front surface and the end surface;

pairs of contacts received in the insulative housing, each contact having a main portion received in the corresponding passageway, a mating portion and a tail portion extending from opposite sides of the main portion; and a spacer defining a plurality of through holes communicating with the passageways for receiving the mating portions of the contacts, the spacer providing pairs of locking arms extending rearwards for penetrating into the passageways;

wherein each contact is plate-shaped with the mating portion and the main portion coplanar with each other, and wherein the tail portion extends sidewards from the main portion and is parallel to the main portion.

15. The power connector as claimed in claim 14, wherein each contact defines a cutout along a top edge and a bottom edge of the main portion, partially portions of the spacer retained in the cutout of corresponding contact to thereby limit a front-to-back displacement of the contacts.

16. The power connector as claimed in claim 14, wherein a pair of guiding posts are integrally formed with the insulative housing, the insulative housing defining a pair of mounting holes adjacent to corresponding guiding posts for facilitating mounting the power connector on the circuit board.

17. A power connector for engaging with a complementary connector, comprising:

an insulative housing defining a plurality of first passageways and a plurality of second passageway communicating with corresponding first passageways; and pairs of contacts received in the insulative housing, each pair of contacts composed by two separated contacts, each separated contact having a main portion assembled in the first passageway, a mating portion extending forwards within the second passageway, and a tail portion extending rearwards out of the insulative housing, each separated contact defining a pair of cutouts along a top and a bottom edges of the main portion;

wherein a height of the first passageway in a cross-section view is larger than a height of the second passageway in a cross-section view;

wherein the insulative housing comprises a first body portion and a second body portion assembled with the first body portion, and wherein the first passageways are defined through the first body portion and the second passageways are defined through the second body portion; and wherein the second body portion of the insulative housing provides a plurality of pairs of locking arms extending rearwards, and wherein each locking arm has a locking end received in the cutout of corresponding contact to thereby limit the contact along the front-to-back direction.

* * * * *